US011459976B2

(12) United States Patent
Klampfer et al.

(10) Patent No.: US 11,459,976 B2
(45) Date of Patent: Oct. 4, 2022

(54) CYLINDER HEAD

(71) Applicant: AVL LIST GMBH, Graz (AT)

(72) Inventors: Martin Klampfer, Hitzendorf (AT); Andreas Zurk, Weinburg (AT)

(73) Assignee: AVL List GmbH, Graz (AT)

( * ) Notice: Subject to any disclaimer, the term of this patent is extended or adjusted under 35 U.S.C. 154(b) by 0 days.

(21) Appl. No.: 17/275,925

(22) PCT Filed: Sep. 9, 2019

(86) PCT No.: PCT/AT2019/060290

§ 371 (c)(1),
(2) Date: Mar. 12, 2021

(87) PCT Pub. No.: WO2020/051607

PCT Pub. Date: Mar. 19, 2020

(65) Prior Publication Data

US 2022/0065191 A1 Mar. 3, 2022

(30) Foreign Application Priority Data

Sep. 14, 2018 (AT) ..... A 50789/2018

(51) Int. Cl.
*F01P 3/14* (2006.01)
*F02F 1/10* (2006.01)
*F02F 1/40* (2006.01)

(52) U.S. Cl.
CPC ..... *F02F 1/40* (2013.01)

(58) Field of Classification Search
CPC .. F01P 3/02; F01P 2003/024; F01P 2003/021; F01P 3/14; F01P 11/00;
(Continued)

(56) References Cited

U.S. PATENT DOCUMENTS 5,379,729 A * 1/1995 Yonezwa ..... F02F 1/4214 123/41.82 R
5,868,106 A * 2/1999 Poropatic ..... F02F 1/4214 123/41.82 R
(Continued)

FOREIGN PATENT DOCUMENTS

DE 102005031243 A1 2/2006
GB 2009846 A * 6/1979 ..... F02B 23/0696
(Continued)

*Primary Examiner* — Long T Tran
(74) *Attorney, Agent, or Firm* — Dykema Gossett PLLC

(57) ABSTRACT

Aspects of the present disclosure are directed to, for example, a cylinder head for an internal combustion engine. In one embodiment of the present disclosure, the cylinder head includes at least one upper partial cooling chamber, a lower partial cooling chamber, an intermediate deck and at least one flow connection. The upper and lower cooling chamber are separated from one another by the intermediate deck. The intermediate deck having an element of single-wall design which extends into a combustion chamber and penetrates the intermediate deck. The at least one flow connection is positioned in the region of the element between the at least one upper and lower partial cooling chambers. The at least one flow connection formed by at least one recess on the element which tapers towards the one lower partial cooling chamber.

19 Claims, 4 Drawing Sheets

(58) Field of Classification Search
CPC ..... F02F 1/242; F02F 1/36; F02F 1/10; F02F 1/26; F02F 2001/104; F02P 13/00
See application file for complete search history.

(56) References Cited

U.S. PATENT DOCUMENTS

| | | | | |
|---|---|---|---|---|
| 5,915,351 | A * | 6/1999 | Regueiro | F02B 19/16 123/285 |
| 2010/0074273 | A1 | 7/2010 | Ishida et al. | |
| 2016/0115897 | A1* | 4/2016 | Pöschl | F02F 1/40 123/41.82 R |
| 2017/0009640 | A1* | 1/2017 | Harada | F01L 1/022 |
| 2017/0306831 | A1* | 10/2017 | Craft | F01P 3/16 |
| 2018/0223768 | A1* | 8/2018 | Miura | F02F 1/40 |

FOREIGN PATENT DOCUMENTS

| | | | |
|---|---|---|---|
| JP | 2009264255 | A | 11/2009 |
| WO | 2008060460 | A1 | 5/2008 |

* cited by examiner

CYLINDER HEAD

CROSS-REFERENCE TO RELATED APPLICATIONS

This application is a national stage filing based upon International application No. PCT/AT2019/060290, filed 9 Sep. 2019, which claims the benefit of priority to Austria application No. A 50789/2018, filed 14 Sep. 2018.

BACKGROUND

The invention relates to a cylinder head for an internal combustion engine having at least one upper partial cooling chamber and one lower partial cooling chamber, which are separated from one another by way of an intermediate deck, having an element which is of single-walled design and extends into a combustion chamber and penetrates the intermediate deck, wherein at least one flow connection between the two partial cooling chambers is formed in the region of the element.

To keep the high temperatures in the cylinder head within a tolerable range for the material, it is customary to cool the cylinder head via cooling chambers. It is provided for this purpose that the coolant is intended to flow through the cylinder head either from a crankcase from the lower cooling section to the upper cooling section or, as in the present invention, from the upper cooling section to the lower cooling section, which is also referred to as top-down cooling.

These two different approaches result in very different flow conditions and cooling conditions in the cylinder head and in the partial cooling chambers.

Such arrangements are known, for example, from AT 510 857 B1. This shows an overflow opening around a receiving socket for a spark plug or an injection nozzle which extends into the combustion chamber. The overflow opening is predetermined by the contour of the intermediate deck and limited by the manufacturing possibilities. Above all, it is not easy to rework the intermediate deck after casting. This makes it more difficult to cool thermally critical areas, especially around the receiving socket. The flows and cooling of the receiving socket depend on the geometry of the opening in the intermediate deck.

A similar cylinder head is also known from DE 10 2005 031 243 B4. This shows a cooling insert around a component which may be an injector or a spark plug. This insert is designed in such a way that it is only an insert around the actual component or around its receiving sleeve. The cooling insert is of double-walled design and its outer walls essentially form a hollow cylinder around the component. The interior of this insert is also of hollow design. The coolant flows from the upper partial cooling chamber through windows in the outer wall of the cooling insert into the interior of the cooling insert and toward the lower partial cooling chamber. Through windows in the outer wall, the coolant in turn flows out of the cooling insert into the lower partial cooling chamber. The flow connection between the upper and lower partial cooling chambers is formed by the cavity between the outer and inner walls. The disadvantage here is that the flow in the insert exhibits undesirable turbulence, since the flow in the cavity cannot be directed specifically without additional means.

A cooling channel arrangement with a tapering flow connection through a recess on the element is known, for example, from GB 2 009 846 A or JP 2009264255 A. In GB 2 009 846 A, the element has semicircular recesses on the surface. However, this arrangement is only possible for very thin-walled elements without causing thermal overheating. As a result, special flow control at thermally highly stressed areas of the receptacle by a spark plug is not possible. In addition, the cylinder head is cooled with coolant from the cylinder block. By the time it reaches the receptacle, the coolant is heated to such an extent that adequate cooling cannot be ensured, especially for prechamber spark plugs. In JP 2009264255 A, a complicated channel arrangement with bores with bends is provided in the receptacle. Although this can achieve a better influence on the flow velocities of the coolant, manufacturing is greatly complicated, however. Due to the flow from below, the coolant is in turn strongly heated until it reaches the thermally highly stressed areas, and sufficient cooling cannot be easily ensured.

SUMMARY OF THE INVENTION

It is the object of the present invention to provide a cylinder head with improved cooling.

This object is solved according to the invention by an initially mentioned cylinder head in that the flow connection is formed by at least one recess on the element which tapers—in particular continuously—towards the lower partial cooling chamber, wherein coolant flows through the recess from the upper partial cooling chamber to the lower partial cooling chamber.

This makes it easy to obtain a predeterminable flow and thus also a flow that can be influenced as required for the cylinder head.

The recess has small dimensions compared to the size of the element, such as holes from the full element.

It is particularly advantageous if at least one recess in the element is groove-shaped, which is open in the direction of a valve bridge and is aligned with its base essentially in the interior of the element. This allows the critical area between the valves to be cooled in particular.

To further enhance this effect, it is favorable if at least one recess opening towards each valve bridge is formed in the element and if preferably three recesses per valve bridge are formed in the element.

It is advantageous if the shape of the intermediate deck contributes to the taper of the flow connection. This is particularly easy to achieve if the intermediate deck has a substantially conical recess in which the element is arranged, and that this recess is preferably created by conical machining of the intermediate deck. As a result, the flow velocity around the element can be positively influenced and advantageously increased.

This makes it easy to focus the flow on the area around an antechamber or in the direction of the combustion chamber. This concentration on these thermally highly stressed areas advantageously takes place before the flow of coolant is diverted into the valve bridges. This results in a significantly improved cooling effect for the area and improved cooling of the wall to the combustion chamber, the combustion chamber plate.

In a particular embodiment, it is provided that at least one channel is provided in the element, which serves for flow connection between the upper and lower partial cooling chambers.

In order to obtain the simplest possible arrangement, it is advantageous if an inlet opening of the channel has a distance from the intermediate deck which is greater than a distance of an initial point of the recess from the intermediate deck. The same advantage arises from an embodiment in which it is provided that the channel is arranged in a radius of the element which is smaller than a radius at which the bottom of the recess in the element is arranged. This makes it possible to arrange the channel inside the recesses, wherein not only the element but also the valve bridges can be cooled all around through the recess. Through the channel, which can be designed as a bore, it is possible to specifically cool the interior of the element.

To achieve good cooling, it is advantageous if the channel has a diameter that has a ratio to the diameter of the element that is between 0.02 and 0.2 and preferably between 0.06 and 0.1, in particular about 0.08.

From the point of view of cooling, it is favorable if, in a particular embodiment, it is provided that the element to the intermediate deck has an annular gap which serves for flow communication between the upper partial cooling chamber and the lower partial cooling chamber.

Cooling via the annular gap can be favorably influenced if the width of the annular gap has a ratio to the diameter of the element which is less than 0.05 and preferably less than 0.02, in particular less than 0.015.

The same effect can be achieved if a recess has a width that has a ratio to the diameter of the element that is less than 0.2 and preferably less than 0.1, in particular about 0.06.

In order to accelerate the flow and thus positively influence and improve the cooling, it is advantageous if the flow connection has an inlet cross-section at a first height along the element in the region of the upper partial cooling chamber and the flow connection has an outlet cross-section at a second height along the element in the region of the lower partial cooling chamber, and that the inlet cross-section and the outlet cross-section are in a ratio to one another which is greater than 1 and preferably above 1.6 and particularly preferably about 1.82.

The flow is also improved if the element has a constriction to a minimum diameter in the area from the flow connection in the intermediate deck, wherein this minimum diameter to diameter ratio is between 0.3 and 0.8, in particular between 0.4 and 0.6, and particularly preferably about 0.46.

BRIEF DESCRIPTION OF THE DRAWINGS

In the following, the invention is explained in more detail with reference to the embodiments in the non-limiting figures, wherein.

DETAILED DESCRIPTION

Figure 1:
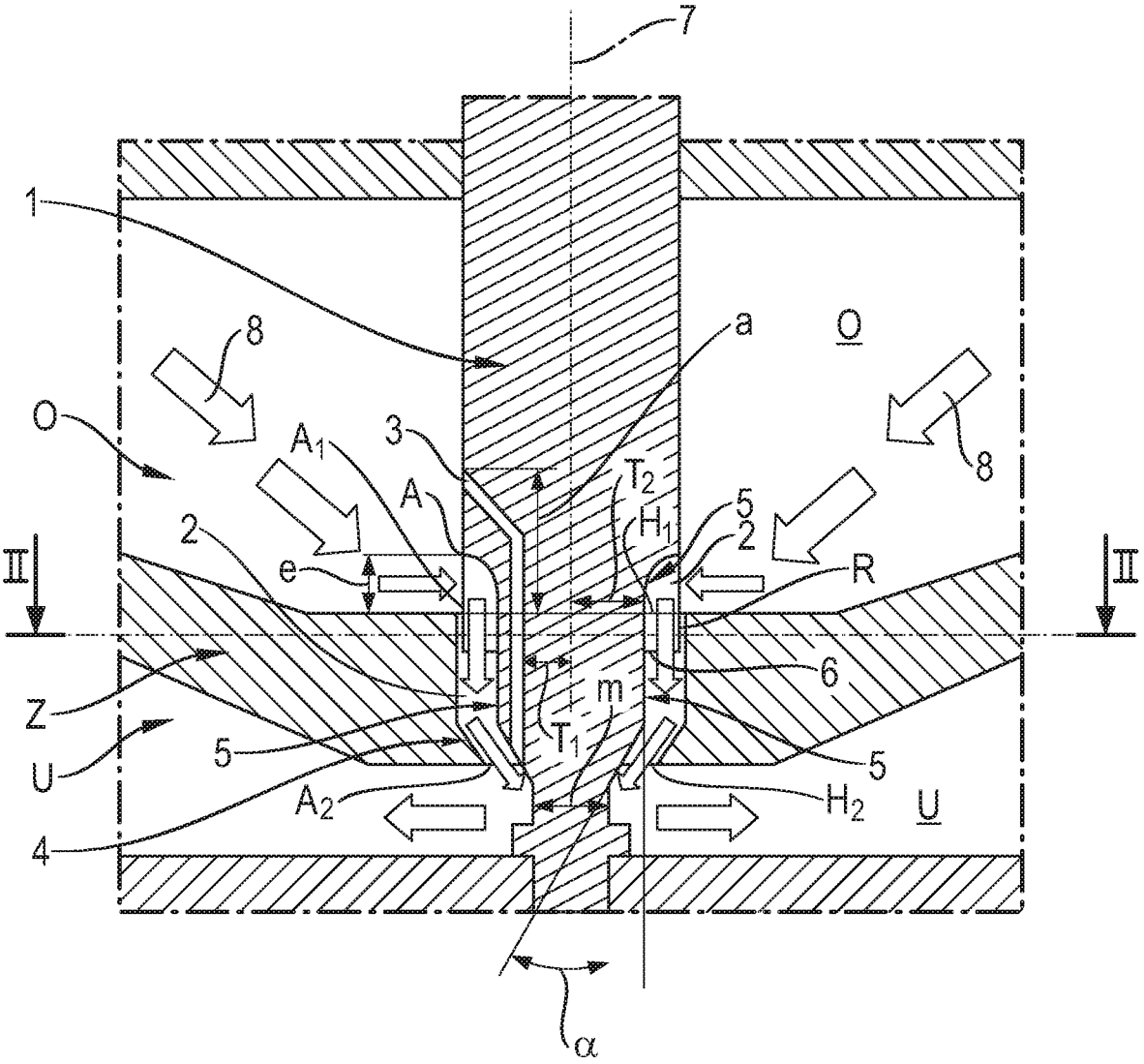
FIG. 1 shows a detail of a cylinder head according to the invention in a first embodiment in a section according to lines I-I in FIG. 2.

FIG. 1 shows an element 1 arranged in a cylinder head of an internal combustion engine (not shown in closer detail). In the embodiment shown, this element 1 is designed as a sleeve for receiving a spark plug. In an embodiment not shown, the element 1 can be designed to receive another component or can also be the corresponding component itself.

Cooling with coolant is provided in said cylinder head. For this purpose, the cylinder head has an upper partial cooling chamber O and a lower partial cooling chamber U separated from it by an intermediate deck Z. The upper partial cooling chamber O and the lower partial cooling chamber U have a flow connection.

In the embodiment shown, this flow connection is formed by several recesses 2 and a channel 3 in the element 1 and by an annular gap R around the element 1. The recesses 2 form this flow connection together with a conical recess 4 in the intermediate deck Z in which the element 1 is arranged.

The recesses 2 are designed as grooves in the element 1, which start from a starting point A. The starting point A designates that point at which the outlet of the groove begins, which in the embodiment shown is curved and in alternative embodiments can be straight. The starting point A of the groove is arranged in the upper partial cooling chamber O and has a distance e from the intermediate deck Z. The bottom 5 of the groove forming the recess 2 is bent or kinked.

In the embodiment shown, the recess 2 is designed as a groove only in the upper area from the upper partial cooling chamber O to the area in the intermediate deck Z. Towards the lower partial cooling chamber U, the recess 2 is designed in such a way that the element 1 has a diameter D which ends in a shoulder 6 at the end of the groove. In this case, the flow connection is formed by the recess 2, which has the shape of a further annular gap. In this case, the annular gap R also merges into this further annular gap.

After a short straight section between element 1 and intermediate deck Z from shoulder 6 in the direction of the lower partial cooling chamber U, element 1 also tapers conically. The conical surface on element 1 starts at the same level as the conical surface on intermediate deck Z. This reduces the flow cross-section through which the coolant flows from the upper partial cooling chamber O into the lower partial cooling chamber U. At this transition from the straight, cylindrical surface on element 1 to the conical surface, element 1 has an angle $\alpha$, which in the embodiment shown is about 40°. In this case, a different amount for the angle $\alpha$ is also possible in other embodiments.

Due to the similar shape of the intermediate deck Z and the conical area on element 1, the coolant in this area is deflected by approximately the angle $\alpha$.

In the area of the lower partial cooling chamber U, element 1 has a minimum diameter m. In this area on element 1, the coolant is directed into the lower partial cooling chamber U in the embodiment shown and deflected by more than 90°. At the same time, the recesses 2 are also continued on element 1 at the minimum diameter m. (This can be seen in more detail in FIG. 3 and is explained in more detail here).

In the embodiment shown, the coolant flows from the upper partial cooling chamber O along the arrows 8 into the uniform annular gap R arranged around the element 1, as well as through the recesses 2 and through the channel 3 or channels 3 into the lower partial cooling chamber U. In the channel 3 and in the recesses 2, the flow is deflected at least once in the embodiment shown, and the taper of the cross-section increases the velocity of the coolant accordingly.

Cooling systems in which the main flow direction is from the upper partial cooling chamber O to the lower partial cooling chamber U are referred to as top-down cooling.

At a first height $H_1$, the flow connection, which forms the sum of channel/channels 3, recesses 2 and annular gap R, has an inlet cross-section $A_1$, and at a second height $H_2$, the flow connection has an outlet cross-section $A_2$. Outlet cross-section $A_2$ and inlet cross-section $A_1$ have a ratio $A_1/A_2$ to each other which is 1.8. This accelerates the flow along the height of element 1.

Furthermore, FIG. 1 shows the arrangement of the channel 3 and the recesses 2 in the element 1. Here, the channel 3 is arranged essentially as a bore in the direction of the axis of rotation 7 of the element 1 at a radius $r_1$ of the element 1. The base 5 of the recess 2 is arranged substantially in a radius $r_2$ in the element. The radius $r_1$ in which the channel 3 is arranged is smaller than the radius $r_2$ in which the base 5 is arranged in the element 1.

Figure 2:
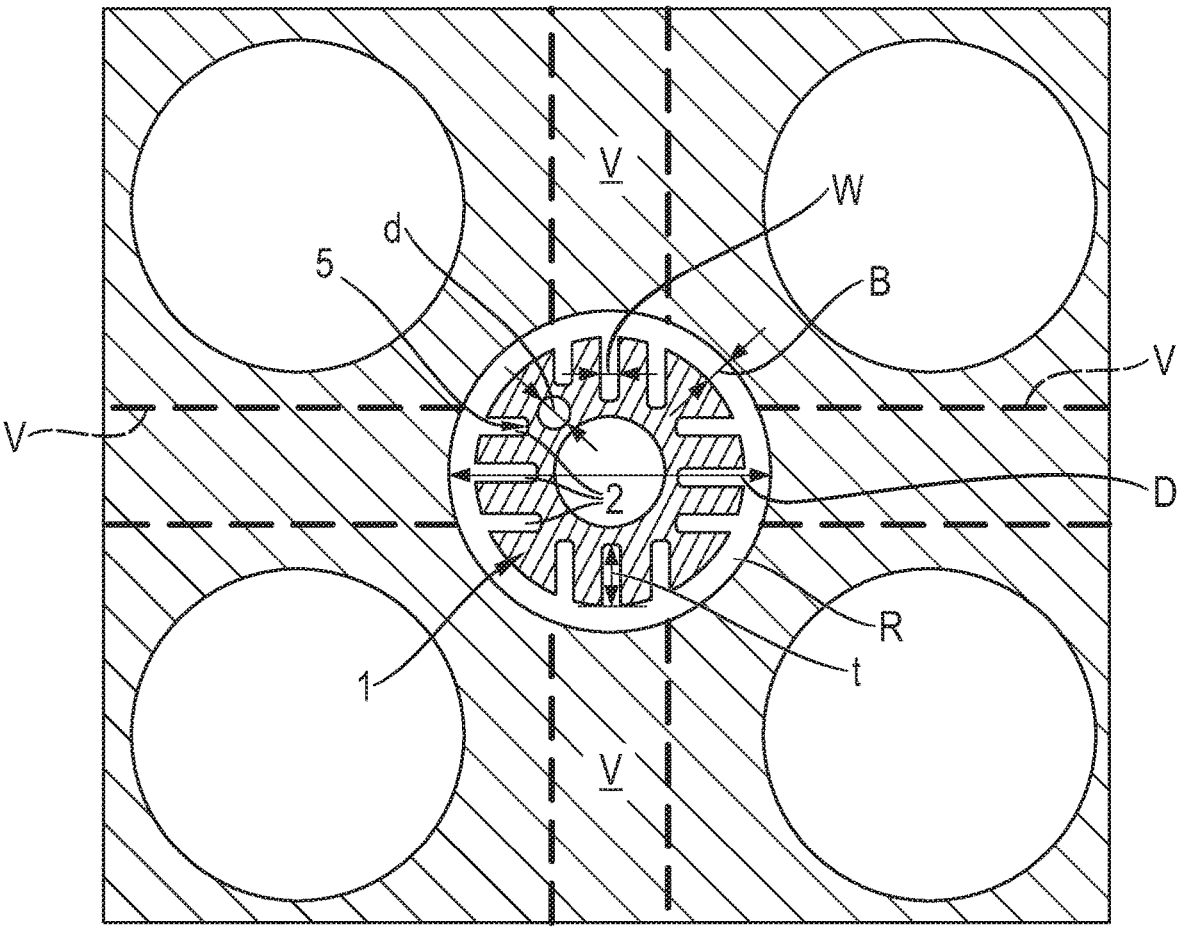
FIG. 2 shows the detail of the cylinder head in a section according to line II-II in FIG. 1.

In FIG. 2, it can be seen that the element 1 has a number of recesses 2 for each valve bridge V. The number of recesses 2 can be varied depending on the cooling requirements and the size of the element 1.

In the embodiment shown, three mutually parallel recesses 2 are provided for each valve bridge V. These recesses 2 represent grooves, the base 5 of which is directed towards the interior of the element 1 in each case.

In the interior of the element 1, the channel 3 can also be seen in extension between two recesses 2. These two recesses 2, which are arranged at 90° to each other, have a smaller depth t inside the element 1. A width w of the recesses 2 is substantially the same for all recesses 2. The channel 3 has a diameter d.

Figure 3:
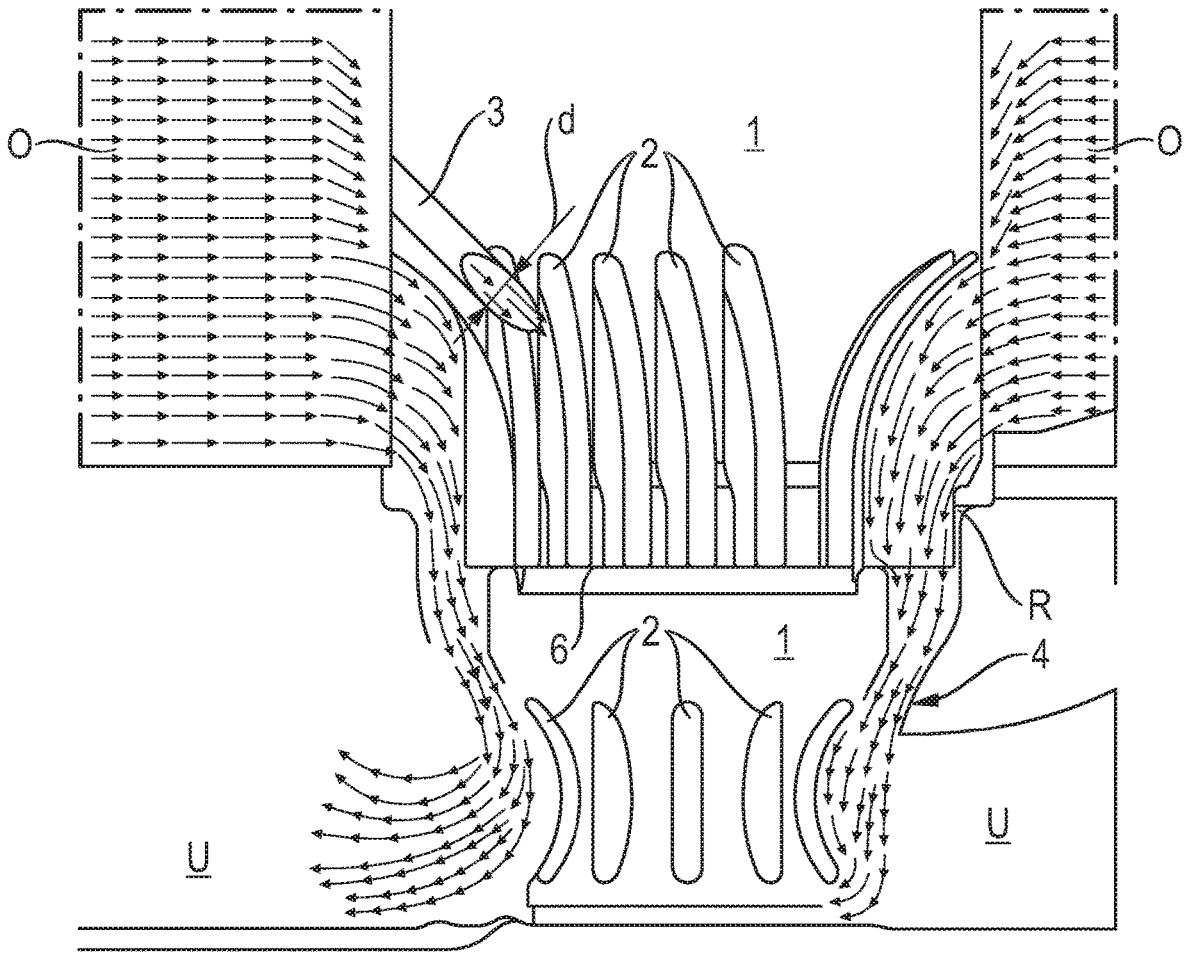
FIG. 3 shows a schematic flow profile of the cylinder head around an element.

FIG. 3 schematically shows a flow profile in and around element 1. Here it can be seen that the flow velocities increase in the direction of the lower partial cooling chamber U. Furthermore, it can be seen in the lower area that after an area in which the recesses 2 on element 1 disappear, the depth t increases again towards the bottom, towards a combustion chamber. This makes it possible to guide the flow better.

Figure 4:
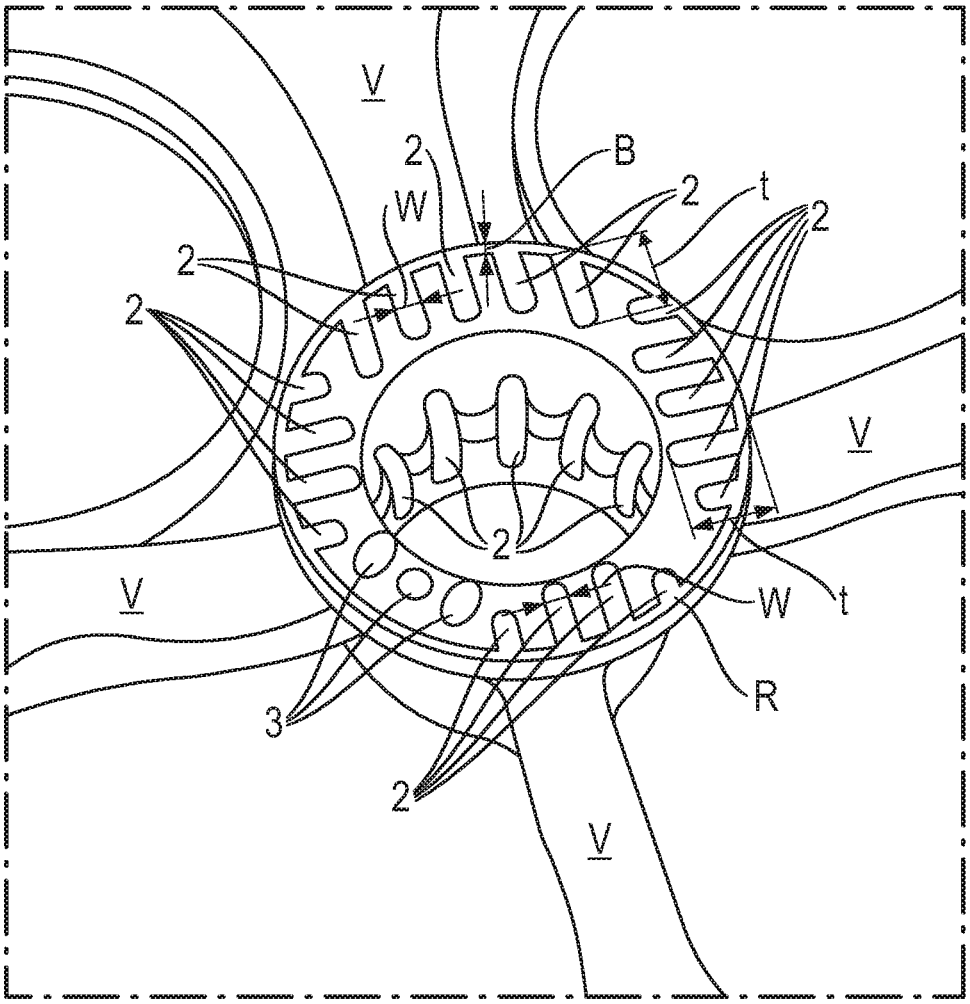
FIG. 4 shows a sketch of the detail analogous to FIG. 1 to FIG. 3 of a cylinder head according to the invention in a second embodiment.

FIG. 4 shows a second embodiment of the cylinder head according to the invention. The main features are designed identically, and only the differences from the first embodiment will be discussed below.

In this second embodiment, the element has five recesses 2 each, which have different depths t, towards two valve bridges V, which are arranged next to each other. Opposite these two groups of recesses 2, only four recesses 2 each are arranged on the element 1 and three channels 3 are provided in between. As can be seen in this illustration, one cooling channel each is also provided in the valve bridges V.

The invention claimed is:

1. Cylinder head for an internal combustion engine, the cylinder head comprising:

at least one upper partial cooling chamber and one lower partial cooling chamber, an intermediate deck separating the at least one upper partial cooling chamber from the one lower partial cooling chamber, the intermediate deck having an element of single-wall design which extends into a combustion chamber and penetrates the intermediate deck, at least one flow connection in the region of the element between the at least one upper partial cooling chamber and the one lower partial cooling chamber, characterized in that the at least one flow connection is formed by at least one recess on the element which tapers towards the one lower partial cooling chamber, wherein coolant within the at least one flow connection is configured and arranged to flow from the at least one upper partial cooling chamber to the one lower partial cooling chamber, wherein the intermediate deck has a substantially conical recess in which the element is arranged.

2. The cylinder head of claim 1, characterized in that the at least one recess in the element is groove-shaped, and wherein the at least one recess is open in the direction of a valve bridge and is aligned with a base substantially in the interior of the element.

3. The cylinder head of claim 2, characterized in that the at least one recess opens towards each valve bridge formed in the element.

4. The cylinder head of claim 2, wherein the at least one recess includes three recesses per valve bridge are formed in the element.

5. The cylinder head of claim 1, further including at least one channel in the element, wherein the at least one channel is configured and arranged for flow connection between the at least one upper partial cooling chamber and the one lower partial cooling chamber.

6. The cylinder head of claim 5, characterized in that an inlet opening of the at least one channel has a first distance from the intermediate deck that is greater than a second distance of a starting point of the recess from the intermediate deck.

7. The cylinder head of claim 5, characterized in that the at least one channel is arranged in a first radius of the element which is smaller than a second radius at which a base of the recess in the element is arranged.

8. The cylinder head of claim 5, characterized in that the at least one channel has a diameter which, with respect to the diameter of the element, has a ratio which is between 0.02 and 0.2.

9. The cylinder head of claim 8, wherein the ratio is between 0.06 and 0.1.

10. The cylinder head of claim 1, characterized in that the element has an annular gap to the intermediate deck configured and arranged to provide a flow connection between the at least one upper partial cooling chamber and the one lower partial cooling chamber.

11. The cylinder head of claim 10, characterized in that the annular gap has a width which, in relation to the diameter of the element, has a ratio which is smaller than 0.05.

12. The cylinder head of claim 11, wherein the ratio is smaller than 0.02.

13. The cylinder head of claim 1, wherein a recess of the at least one recess has a width which, in relation to the diameter of the element, has a ratio which is smaller than 0.2.

14. The cylinder head of claim 13, wherein the ratio is smaller than 0.1.

15. The cylinder head of claim 1, wherein the at least one flow connection has an inlet cross-section at a first height along the element in the region of the at least one upper partial cooling chamber and the at least one flow connection has an outlet cross-section at a second height along the element in the region of the one lower partial cooling chamber, and in that the inlet cross-section and the outlet cross-section are in a ratio to one another which is greater than 1.

16. The cylinder head of claim 15, wherein the ratio is above 1.6.

17. The cylinder head of claim 1, wherein the element, in the region from the at least one flow connection in the intermediate deck, has a constriction to a minimum diameter, wherein the minimum diameter has a ratio to the diameter which is between 0.3 and 0.8.

18. The cylinder head of claim 1, wherein the at least one recess is a conical tapering recess.

19. The cylinder head of claim 1, wherein the recess is produced by conical machining of the intermediate deck.

* * * * *